US009976094B2

(12) United States Patent
Jemmett et al.

(10) Patent No.: US 9,976,094 B2
(45) Date of Patent: May 22, 2018

(54) UPGRADING KEROSENE TO JET FUEL WITH CARBONACEOUS DESORPTION AND FILTRATION

(71) Applicant: PHILLIPS 66 COMPANY, Houston, TX (US)

(72) Inventors: Mark R. Jemmett, Owasso, OK (US); Zhenhua Mao, Bartlesville, OK (US); Jesse Contreras, Bartlesville, OK (US); Matthew J. Lundwall, Bartlesville, OK (US)

(73) Assignee: Phillips 66 Company, Houston, TX (US)

( * ) Notice: Subject to any disclaimer, the term of this patent is extended or adjusted under 35 U.S.C. 154(b) by 0 days. days.

(21) Appl. No.: 15/376,145

(22) Filed: Dec. 12, 2016

(65) Prior Publication Data

US 2017/0107431 A1 Apr. 20, 2017

Related U.S. Application Data

(63) Continuation-in-part of application No. 14/969,001, filed on Dec. 15, 2015, and a continuation-in-part of application No. 14/969,006, filed on Dec. 15, 2015, and a continuation-in-part of application No. 14/969,014, filed on Dec. 15, 2015, and a continuation-in-part of application No. 14/969,019, filed on Dec. 15, 2015, and a continuation-in-part of application No. 14/969,037, filed on Dec. 15, 2015, and a continuation-in-part of application No. 14/969,049, filed on Dec. 15, 2015, and a continuation-in-part of application No. 14/969,064, filed on Dec. 15, 2015.

(60) Provisional application No. 62/093,576, filed on Dec. 18, 2014, provisional application No. 62/093,668, filed on Dec. 18, 2014, provisional application No. 62/093,690, filed on Dec. 18, 2014, provisional (Continued)

(51) Int. Cl.

| | |
|---|---|
| ***C10G 25/06*** | (2006.01) |
| ***C10G 25/12*** | (2006.01) |
| ***C10G 25/00*** | (2006.01) |
| ***C10G 31/09*** | (2006.01) |

(52) U.S. Cl.

CPC ..... *C10G 25/003* (2013.01); *C10G 25/06* (2013.01); *C10G 25/12* (2013.01); *C10G 31/09* (2013.01); *C10G 2300/1051* (2013.01); *C10G 2300/202* (2013.01); *C10G 2300/205* (2013.01)

(58) Field of Classification Search

CPC ..... C10G 25/003; C10G 25/06; C10G 25/12; C10G 31/09

See application file for complete search history.

(56) References Cited

U.S. PATENT DOCUMENTS

2008/0308464 A1* 12/2008 Osaheni ..... B01J 20/3458 208/251 R
2008/0308465 A1* 12/2008 Osaheni ..... C10G 25/05 208/253
2012/0132566 A1* 5/2012 Janssen ..... C10G 25/003 208/86

* cited by examiner

*Primary Examiner* — Renee Robinson
(74) *Attorney, Agent, or Firm* — Phillips 66 Company

(57) ABSTRACT

The invention relates to removing contaminants from jet fuel or kerosene using solid sorbents that are comprised primarily of carbon and preferably of coke particles. The coke particles have an affinity for contaminants in jet fuel and kerosene and are sized to be filtered from the liquid fuel without plugging. As the contaminants agglomerate onto the solid sorbent, the resulting particles form a filter cake on (Continued)

conventional filter materials in such a way as to allow the jet fuel or kerosene to pass on through without significant pressure drop or delay.

10 Claims, 2 Drawing Sheets

Related U.S. Application Data application No. 62/093,708, filed on Dec. 18, 2014, provisional application No. 62/093,722, filed on Dec. 18, 2014, provisional application No. 62/093,797, filed on Dec. 18, 2014, provisional application No. 62/093,832, filed on Dec. 18, 2014.

UPGRADING KEROSENE TO JET FUEL WITH CARBONACEOUS DESORPTION AND FILTRATION

CROSS-REFERENCE TO RELATED APPLICATIONS

This application is non-provisional application which claims benefit under 35 USC § 120 as a continuation-in-part application of the following non-provisional U.S. patent applications: Ser. No. 14/969,001 filed Dec. 15, 2015, entitled "Sorbents for Removing Solid Particles from Crude Oil"; Ser. No. 14/969,006 filed Dec. 15, 2015, entitled "A Mixture of Crude Oil and Solid Hydrocarbon Particles"; Ser. No. 14/969,014 filed Dec. 15, 2015, entitled "A Mixture of Crude Oil and Solid Hydrocarbon Particles"; Ser. No. 14/969,019 filed Dec. 15, 2015, entitled "A System for Purifying Crude Oils"; Ser. No. 14/969,037 filed Dec. 15, 2015, entitled "A System for Regenerating Adsorbents for Purifying Crude Oils"; Ser. No. 14/969,049 filed Dec. 15, 2015, entitled "Upgrading Biofuel Crude Oils with Solid Sorbents for Petroleum Refinery Processing"; and Ser. No. 14/969,064 filed Dec. 15, 2015, entitled "A Process for Purifying Petroleum Crude Oils", all of which claim benefit under 35 USC § 119(e) to the following U.S. Provisional Applications: Ser. No. 62/093,576 filed Dec. 18, 2014, entitled "Sorbents for Removing Solid Particles from Crude Oil"; Ser. No. 62/093,668 filed Dec. 18, 2014, entitled "A Mixture of Crude Oil and Solid Hydrocarbon Particles"; Ser. No. 62/093,690 filed Dec. 18, 2014, entitled "A Mixture of Crude Oil and Solid Hydrocarbon Particles"; Ser. No. 62/093,708 filed Dec. 18, 2014, entitled "A System for Purifying Crude Oils"; Ser. No. 62/093,722 filed Dec. 18, 2014, entitled "A System for Regenerating Adsorbents for Purifying Crude Oils"; Ser. No. 62/093,797 filed Dec. 18, 2014, entitled "Upgrading Biofuel Crude Oils with Solid Sorbents for Petroleum Refinery Processing"; and Ser. No. 62/093,832 filed Dec. 18, 2014, entitled "A Process for Purifying Petroleum Crude Oils", all of the above applications hereby being incorporated herein to this application in their entirety.

STATEMENT REGARDING FEDERALLY SPONSORED RESEARCH OR DEVELOPMENT

None.

FIELD OF THE INVENTION

This invention relates to contaminants from fuel and particularly to removing contaminants from jet fuel and kerosene.

BACKGROUND OF THE INVENTION

Jet fuel used in airplanes must be capable of enduring conditions at a great range of altitudes. Therefore, the standards for jet fuel are established to handle a range of temperatures and pressures within the fuel tanks, within the fuel supply system and in the jet engines themselves prior to combustion, without creating hazards. However, there are a number of different jet fuels used for different types of jet engines. This is especially true for military jets that fly at very high speeds or at very high altitudes. One of the known hazards of concern is the thermal degradation generally caused by cyclic, aromatic and polar molecules in the jet fuel. Such materials form solid deposits that if attached to a critical location in the engine or fuel supply system could create a serious and possibly catastrophic problem. Much effort has been devoted to testing fuel and setting standards for fuel including the Jet Fuel Thermal Oxidation Test generally abbreviated JFTOT. Specifications for jet fuel are well defined and manufacturers of jet fuel that use feed stocks that are low cyclic, aromatic and polar molecules are able to capture full value for their products. Manufacturers using less desirable feedstocks must undertake efforts to reduce the content of such molecules from the jet fuel products or direct those products into other markets, such as diesel or home heating oil, capturing less value.

If a refinery had access to a fast, effective and low cost processes for separating out the undesirable components, that refinery would make a lot of candidate feedstocks suitable for use in making jet fuel that will meet the well-defined and highly critical jet fuel standards resulting in the production of high value products from lower cost sources. Such a process would be highly desired. Hydrogenation processing of the jet fuel saturates aromatics and will open rings on cyclic molecules. Certain clay materials have been used to filter out kerosene contaminants, but not with great success.

BRIEF SUMMARY OF THE DISCLOSURE

The invention more particularly relates to a process for removing contaminants from jet fuel where a solid sorbent is added to the jet fuel and the contaminants from the jet fuel are agglomerated or adsorbed to the solid sorbent, and then the solid sorbent with agglomerated/adsorbed contaminants is separated from the jet fuel.

The invention may also be seen as relating to a process for removing contaminants from kerosene where a solid sorbent is added to kerosene and the contaminants from the kerosene are agglomerated or adsorbed to the solid sorbent, and then the solid sorbent with agglomerated/adsorbed contaminants is separated from the kerosene.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

In the present invention, it has been found that carbonaceous materials can be tailored to attach to contaminants in kerosene and particularly to contaminants in jet fuel to create particles large enough to be easily filtered and separated from the liquid fuel. The primary contaminants that are desired to be removed are $H_2S$, amines, mercaptans, metals and salts. Other contaminants that may need to be removed are compounds with heteroatoms such as nitrogen, sulfur, oxygen and cyclic molecules and aromatics such as benzene, toluene and xylene and ethyl benzene. All of these are undesirable in kerosene and especially in jet fuel. It has been found that anode and higher grade cokes, such as petroleum cokes, charcoal, wood char and similar carbonaceous materials may be prepared to attach to the undesired molecules for subsequent filter removal.

The carbonaceous materials are preferably heat treated to create the desired affinity for the target contaminants and then selected for a suitable size and surface area. For carbonaceous materials that are comprised of petroleum coke particles, it is preferred that such coke particles have not been calcined, sometimes called green coke particles. The green coke particles are selected to have an average particle size of at least 1 micron up to about 500 microns where an average size up to about 250 microns is generally more preferred and with particles being between 5 and 50 microns being somewhat more preferred. The coke may be heat treated, up to about 500° C. in nitrogen prior to use with jet fuel or kerosene.

The coke or carbonaceous particles are blended with the kerosene or jet fuel for a sufficient time to attach themselves to the contaminants to form larger particles that are more amenable to separation from the fuel in a filter and then directed to a filter for solid separation. Once the filtrate is removed, the contaminated carbonaceous materials may be used as fuel to create process heat within a refinery or the carbonaceous particles may be reprocessed to remove or separate the contaminants from the carbonaceous particles such that the same particles may be used in a subsequent cycle or may be used as a fuel, such as an industrial fuel without reprocessing.

The green coke is mixed into the jet fuel or kerosene and thoroughly dispersed to provide for substantial contact with contaminates as can be efficiently accomplished.

Figure 1:
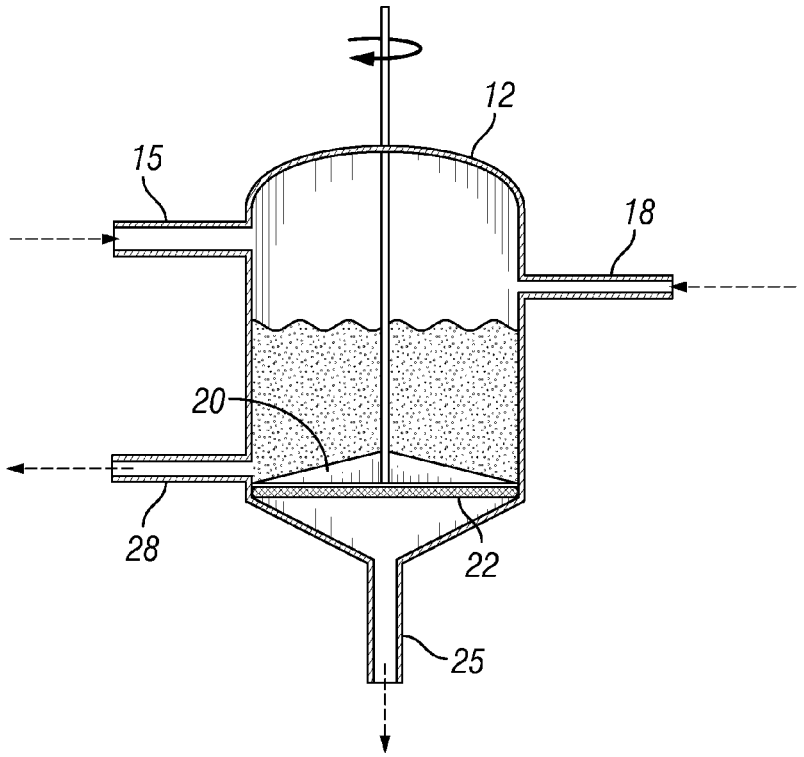
FIG. 1 is a schematic drawing of a first embodiment of process for removing contaminants from jet fuel.

As shown in FIG. 1, the jet fuel or kerosene is directly to a mixing tank 12 from a supply line 15. The solid sorbent is added at delivery station 18 and the mixture of jet fuel or kerosene and solid sorbent is blended by agitator 20. The mixture of jet fuel or kerosene having the solid sorbent thoroughly dispersed therein is then separated by filter element 22 allowing the decontaminated jet fuel or kerosene to pass through outlet 25 while wet solid sorbent with agglomerated contaminants thereon are allowed out through contaminant outlet 28.

Figure 2:
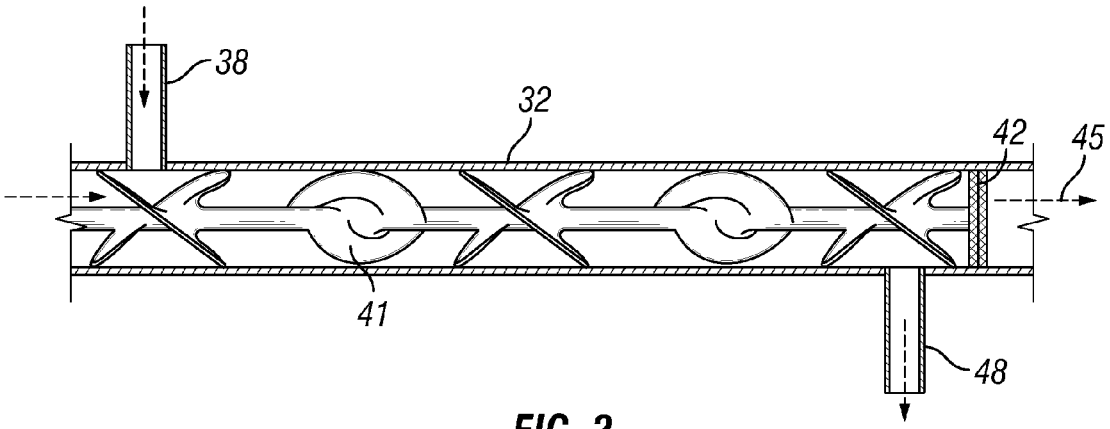
FIG. 2 is a schematic drawing of a second embodiment of the process of separating contaminants of jet fuel.

It should be understood that a number of embodiments for the inventive system may be defined such as shown in FIG. 2 where a section of pipe 32 for transporting jet fuel or kerosene includes an inlet 38 for sorbent. The sorbent is blended and dispersed through the jet fuel or kerosene via a static mixer 41. A filter element 42 is positioned at the end of the pipe section 32 defining a jet fuel or kerosene outlet 45 and a contaminant outlet 48. The pipe section 32 may be horizontal, vertical with the flow going up or down or any other angle. The filter element 42 may be perpendicular to the flow of the jet fuel or kerosene through the pipe section 32, perpendicular to the pipe section 32 (such as in the side walls) or any other practical orientation in the pipe section 32. Similarly, the contaminant outlet may also be arranged at an angle to the pipe section or straight out the end.

The kerosene or jet fuel mixture comprises between 95% and 99.9% kerosene or jet fuel and between 0.05% and 5% green petroleum coke solid sorbent. In one preferred arrangement, the green petroleum coke solid sorbent has an average size between about 2 microns and about 50 microns although sizes between about 5 microns and about 15 are especially preferred. The mass ratio of jet fuel or kerosene to sorbent may be maintained at a ratio of at least 1 kg sorbent to 500 kg of jet fuel or kerosene. More preferably, the jet fuel or kerosene would include a higher ratio of sorbent such that at least 5 kg of sorbent would be thoroughly mixed with 500 kg of jet fuel or kerosene such that the ratio is 100:1. The ratio may include up to 1 kg of sorbent to 2 kg of jet fuel or kerosene when the jet fuel or kerosene is heavily laden with contaminants, but as a practical matter, it is more likely that the ratio will be between 100:1 and 10:1. The composition may be maintained at a temperature that is elevated above average room temperature but less than 200° C.

The density of the sorbent is preferably between 0.5 g/cc and 7 g/cc and more preferably between 0.7 g/cc and 2.0 g/cc. The sorbent particles are partially or almost totally hydrocarbon materials that contain a residual carbon content of at least 40%, preferably between 75% and 99%, more preferably between 85% and 98%. The residual carbon content is defined by ASTM D7662-13.

Figure 3:
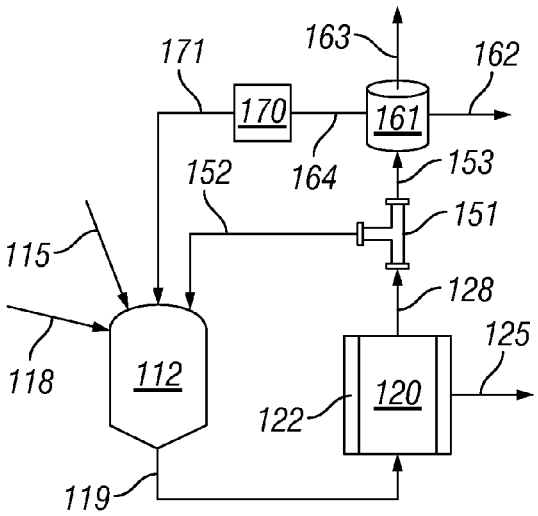
FIG. 3 is a schematic drawing of a third embodiment of a process for separating contaminants of oil including a system for activating the solid sorbent to have an affinity for certain contaminants.

The wet green coke with the agglomerated/adsorbed contaminants may be processed for re-use. As shown in FIG. 3, a mixing tank 112 is provided for mixing kerosene and solid adsorbent. Jet fuel or kerosene is supplied at inlet 115 and fresh adsorbent is supplied at inlet 118. After mixing using a suitable mixing technology, the mixture is conveyed via line 119 to separation device 120 including filter media 122. While one separation device 120 is shown, it should be understood that multiple such devices may be included where some are in use having a filter cake formed on the media 122 while other separation devices 120 are offline having the filter cake flushed or back-flushed for further treatment. The cleaned jet fuel or kerosene is removed through outlet 125 and carried on for further processing in the refinery or isolated for transport or sale and the contaminant laden adsorbent exits via line 128. The sorbent is subjected to further separation at sorbent separator 151. Some solid sorbent 152 is returned to the mixing tank 112 while remaining sorbent with jet fuel or kerosene is delivered to regenerator 161 via line 153. While the amount of jet fuel or kerosene with the sorbent in sorbent regenerator 161 is small compared to the jet fuel or kerosene recovered at outlet 125, clean jet fuel is discharged through outlet 162 and isolate for shipment and sale or directed for further processing the refinery. The re-generation process includes recovery of liquid oil and thermal treatment of the solid material to liberate or pyrolize the contaminants. The wet sorbent after adsorption first goes through evaporation to recover the jet fuel or kerosene at an elevated temperature either under reduced atmosphere pressure or at ambient pressure. The dried solid powder is subjected to the specific thermal treatment either under reduced atmosphere pressure or at a pressure less than 15 psi. The sorbent is subjected to regenerating temperatures that are at least 100° C., preferably between 100° C. and 1000° C., more preferably between 200° C. and 750° C., even more preferably between 250° C. and 550° C. The atmosphere for the thermal treatment is preferably inert; nitrogen gas and other hydrocarbon gas are preferred.

Regenerated green coke sorbent is delivered to the mixing tank 112 via line 164 and 171. It is noted that a device 170 is shown for providing an alternative treatment for the sorbent as will be described below. The regenerated coke sorbent attains substantial amounts of its sorbent functionality through regeneration, but the step typically includes some selection by sizing eliminating sorbent particles that have attritted down to an unacceptable size and eliminated from the process through discharge 163. Using recycled sorbent is a low cost way to reuse sorbent that provides some level of sorbent function, but especially helps by increasing the available surface area within the crude mixing tank so as to create many contact opportunities by the sorbent and the contaminants.

Figure 4:
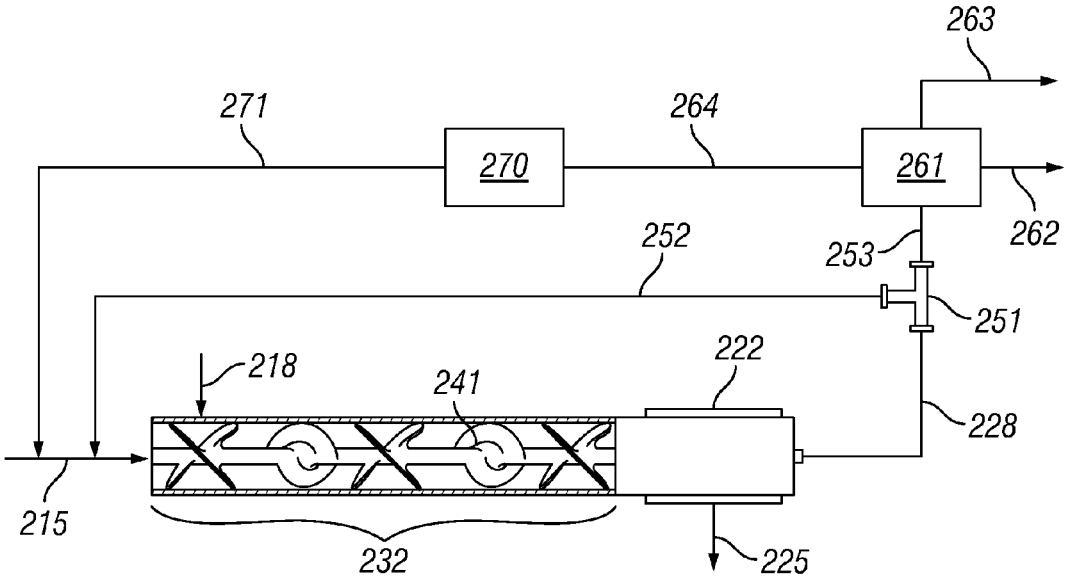
FIG. 4 is a schematic drawing of a fourth embodiment of a process for separating contaminants of jet fuel including a system for activating the solid sorbent to have an affinity for certain contaminants.

The process may further be accomplished with a system having a different appearance but similar operations as shown in FIG. 4 where the jet fuel or kerosene enters a mixing area 232 via inlet 215. Fresh green coke sorbent is delivered via inlet 218. The sorbent and jet fuel or kerosene are mixed together by a mixer 241, such as a static mixing element as shown. The cleaned or decontaminated crude exits through outlet 225 after passing through filter media 222. The jet fuel or kerosene laden sorbent is carried on through line 228 for further separation at sorbent separator 251. Some solid sorbent 252 is returned to the mixing zone 232 while remaining sorbent with jet fuel kerosene is delivered to regenerator 261 via line 253. While the amount of jet fuel or kerosene with the sorbent in sorbent regenerator 261 is small compared to the jet fuel or kerosene recovered at outlet 225, clean jet fuel or kerosene is discharged through outlet 262 and isolated for shipment and sale or directed for further processing the refinery. The re-generation process includes recovery of jet fuel or kerosene and thermal treatment of the solid material. The wet sorbent after adsorption first goes through evaporation to recover the liquid oil at an elevated temperature either under reduced atmosphere pressure or at ambient pressure. Regenerated green coke sorbent is delivered to the mixing zone 232 via line 264 and 271. Device 270 provides an optional treatment for the sorbent as described below. The regenerated coke sorbent attains substantial amounts of its sorbent functionality through regeneration, but the step typically includes some selection by sizing eliminating sorbent particles that have attritted down to an unacceptable size and eliminated from the process through discharge 263.

Some crude oils contain corrosive compounds such as various nitrogen-containing compounds that may end up in the jet fuel or kerosene. With the solid adsorption process, these soluble basic species may also be effectively removed from jet fuel or kerosene by including an acidifying treatment to the green coke sorbent. This acidifying treatment may be applied in device 170 or 270 as shown in FIGS. 3 and 4. For the applications where basic species need to be removed, the atmosphere is preferably oxidative; oxygen gas and other oxidative gases such as various acids and peroxides are also introduced into the atmosphere so that carbonaceous species on the sorbent surface are oxidized to form acidic groups. These acidic groups on the sorbent surface provide the functionality of absorbing basic species. The acidifying regenerating step would be performed in the regenerator 161.

With a blend of fresh green coke and acidified green coke particles, the same materials being adsorbed/agglomerated as first described are still being adsorbed and agglomerated, but there are now sorbent particles that also adsorb the basic or alkaline molecules.

The process is particularly applicable to removing cyclic or ring compounds, aromatics and polar compounds from jet fuel or kerosene. The solid sorbents are dispersed in the jet fuel or kerosene such that solid sorbent particles and jet fuel or kerosene has sufficient contact, resulting in full adsorption of the solid particles (ultrafine and micron sized organic and inorganic solid material) in the jet fuel or kerosene. The resulting solid sorbent and liquid jet fuel or kerosene is separated continuously or semi-continuously through filtration. The details are described below.

Referring to FIG. 1, the process according to this invention includes two simultaneous major steps: (a) mixing solid sorbent with crude oil and (b) separating impurity solid and salt particle-loaded sorbent particles from liquid crude oil. The special sorbent materials according to this invention enable such operation to be effective and economically viable.

Even though conventional solid sorbents such as activated carbon or filtration aid agent such as silicate and Celite® may be used as the sorbent for this purpose, green coke particles are preferred because those conventional sorbents are relatively expensive and may not have the affinity with hydrocarbons compared with particulate green coke materials. The so called "green coke" materials herein are petroleum cokes or charred coal tars before calcination (>1000° C.) that contain a certain amount of volatile content. Preferably the green coke has carbon content between 25% and 99.0%, more preferably between 75% and 98%. The amount of volatile content in a green coke may reflect the mechanic strength of green coke particles and the affinity of such coke surface with crude oil; a too high volatile content may lead to too weak mechanic strength of green coke particles, which may cause breaking-up of particles on collision of particles. A too high carbon content (e.g. >99.5%) may yield a low affinity with crude oils, which may have a low adsorption ability for large and polar molecules that are preferably removed from crude oil.

It should be pointed out here that the above sorbent or green coke materials may also contain significant amount of inorganic solids, the carbon content aforementioned is the hydrocarbon portion in the sorbent.

The size of green coke particles is important factor in determining adsorption rate and maximum loading of adsorbed solid particles. The smaller the particle size the larger the surface area and the faster for adsorption. However, the smaller particle size also may lead to the denser filtration cake layer on the filtration screen, resulting in a slower liquid flow rate. To achieve a fast adsorption rate and a good liquid flow through the filtration screen, the average green coke particle size is preferably between 3 and 500 μm, more preferably between 5 and 50 μm.

As noted above, the specifications for jet fuel can be quite rigorous. The color of jet fuel and kerosene indicate the presence of contaminants. The color of the resulting kerosene without these contaminants may be improved and should be less corrosive with amines and hydrogen sulfide removed. One of the tests used for kerosene and jet fuel is a copper corrosion test. Jet fuel and kerosene having been subjected to sorption by the carbon particles of the present invention show much better copper corrosion tests as compared to any other sorbent tested and untreated jet fuel and kerosene.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

The discussion of any reference is not an admission that it is prior art to the present invention, especially any such reference that has a publication date after the priority date of this application. Incorporated references are listed here for convenience:

U.S. Pat. No. 2,090,007
British Patent 1082169 (A)
U.S. Pat. No. 3,529,944
U.S. Pat. No. 6,485,633

The invention claimed is:

1. A process for removing contaminants from jet fuel comprising:

a) adding a solid sorbent to the jet fuel wherein the solid sorbent is a mixture of green coke and recycled green coke that has been subjected to an inert heating process to liberate contaminants from a previous contaminant adsorption process;

b) agglomerating/adsorbing contaminants from the jet fuel to the solid sorbent;

c) separating the solid sorbent with agglomerated/adsorbed contaminants from the jet fuel;

d) separating undersized solid sorbent particles separated from the jet fuel prior to recycling such solid sorbent so as to maintain a desired particle size for the solid sorbent used in the contaminant removal process; and e) heating the solid sorbent to liberate the contaminants from the solid sorbent and to prepare the solid sorbent for recycling for re-use as solid sorbent in step a).

2. The process according to claim 1 wherein the green coke has an average size of between 1 and 250 microns.

3. The process according to claim 1 wherein the green coke has an average size of between 3 and 50 microns.

4. The process according to claim 1 wherein the green coke has an average size of between 3 and 25 microns.

5. The process according to claim 1 wherein the mixture of green coke and recycled green coke has an average particle size of between 1 and 250 microns.

6. The process according to claim 1 wherein the mixture of green coke and recycled green coke has an average size of between 3 and 50 microns.

7. The process according to claim 1 wherein the mixture of green coke and recycled green coke has an average size of between 3 and 25 microns.

8. The process according to claim 1 further including a step of de-wetting the solid sorbent with contaminants agglomerated thereon so as to remove any residual jet fuel from the solid sorbent.

9. The process according to claim 1 wherein the solid sorbent is subjected to a heat treatment step of up to 500 C. in a nitrogen environment prior to the step of adding solid sorbent to the kerosene.

10. The process according to claim 1 wherein the separation of the sorbent from the jet fuel occurs in a generally vertical tank with a jet fuel feed and solid sorbent delivered to the top and mixed bay a bladed stirrer attached to a generally vertical shaft that is rotated to stir the jet fuel and solid sorbent mixture in the vessel and further wherein a filter is arranged generally horizontally such that the solid sorbent is exits adjacent the filter and the jet fuel exits below the horizontal filter.

* * * * *